US005785446A

United States Patent [19]

Dlugos

[11] Patent Number: 5,785,446

[45] Date of Patent: Jul. 28, 1998

[54] BINDING DEVICE FOR SECURING BOOKLETS INTO BINDERS

[75] Inventor: Daniel F. Dlugos, Shelton, Conn.

[73] Assignee: Pitney Bowes Inc., Stamford, Conn.

[21] Appl. No.: 751,593

[22] Filed: Nov. 18, 1996

[51] Int. Cl.[6] ..... B42F 13/00

[52] U.S. Cl. ..... 402/79; 281/38; 281/21.1; 402/500

[58] Field of Search ..... 402/79, 500; 281/38, 281/28, 21.1, 22, 23

[56] References Cited

U.S. PATENT DOCUMENTS

| | | | |
|---|---|---|---|
| 4,127,690 | 11/1978 | Schleifenbaum et al. | 402/79 |
| 4,139,216 | 2/1979 | Saint Clair | 281/4 |
| 4,430,015 | 2/1984 | Nerlingen | 402/79 |
| 4,793,758 | 12/1988 | Hanson et al. | 412/4 |
| 4,898,405 | 2/1990 | Pickering et al. | 281/29 |
| 4,910,066 | 3/1990 | Foissie | 402/79 X |
| 5,052,872 | 10/1991 | Hunder et al. | 412/6 |
| 5,135,259 | 8/1992 | Garza | 281/29 |
| 5,178,414 | 1/1993 | Small et al. | 281/35 |
| 5,248,164 | 9/1993 | Lepretre | 281/28 |
| 5,445,467 | 8/1995 | Peleman | 402/57 |
| 5,445,468 | 8/1995 | Pacione | 402/75 |
| 5,590,972 | 1/1997 | Shobin | 281/38 X |

*Primary Examiner*—Willmon Fridie, Jr.
*Attorney, Agent, or Firm*—Melvin J. Scolnick; Robert H. Whisker; David E. Pitchenik

[57] ABSTRACT

A binding device for removably securing bound booklets into a storage binder is disclosed in which an elongate strip of semi rigid material is provided with adhesive or removable securing means by which it is attached to a rear surface edge portion of a bound booklet, and also punched holes or additional removable securing means by which it is attached to the inside of a conventional ring binder or other type of suitable hard cover storage binder.

9 Claims, 3 Drawing Sheets

BINDING DEVICE FOR SECURING BOOKLETS INTO BINDERS

BACKGROUND OF THE INVENTION

The present invention relates generally to the field of organization and storage of printed material, and more particularly to a binding device for securing bound booklets into various types of storage binders from which they can be easily removed for use.

This invention is particularly useful in connection with various types of printed materials which are bound into booklet form, such as magazines, reports, data compilations and records, log books, note books, text books, guide books, and a variety of other types of information and data which is created and compiled into booklets. Typically these booklets will consist of a relatively large number of pages, ranging from such typical magazines such as Time or Newsweek, to research reports which may be half to three quarters of an inch thick, such an engineering laboratory note books. The range of booklets to which the present invention has utility is virtually limitless, the only critical factor of the booklet relevant to the applicability of the present invention being that the booklet is bound in some form. Relatively thin booklets may be merely stapled, while thicker booklets may be stitched or glued. Regardless of the manner in which the booklets are bound, the binding is generally intended to be permanent, although this is not necessarily critical to the applicability of the present invention to the booklet.

There are many situations in which it is both convenient and desirable to bind printed material which has been pre-bound into booklet form into hard cover binders for organization, storage and retrieval. For example, libraries typically store many of the above mentioned types of booklets, particularly corporate libraries and those of governmental and private research organizations that generate huge quantities of text, data and graphic information and that have a need to retain this information in readily available form. Some other examples are research facilities, various business organizations, governmental facilities, legal and medical facilities, courts, and other such organizations that generate a substantial amount of information and data, all of which have a similar need to retain and retrieve the information. Thus, the types of situations to which the present invention has applicability are also virtually limitless.

The concept of securing bound booklets into hard cover binders has long been well known, and there is a variety of binders commercially available for this purpose. For example, the very well known ring binder, in which a plurality of split rings can be opened to receive a sheet or sheets which have been punched with holes to match the number and spacing of the rings, can be readily utilized to hold bound booklets which have been similarly pre-punched. In many situation, the booklets are punched when they are bound. This system often proves to be unsatisfactory for the reason, among others, that the booklets will not lie flat when opened in the ring binder unless the peripheral shape of the rings precisely matches the circular trajectory of the booklet holes when pages of the booklet are turned from one side of the binder to the other. In the typical situation, the booklet must be removed from the binder in order to read it without tearing the pages adjacent the holes, which prevents the booklet from being securely bound into the ring binder. Also, punching booklets, especially thick ones, often results in the holes being punched through text, unless a large margin is left on the pages during printing, which is not normally done.

Another common method employed for binding magazines into hard cover binders is the use of rigid but flexible rods that are inserted into the centerfold of the magazine and which are then inserted into holding device fixed to the outer edges of the spline of the binder. The rods are often difficult to insert into the binder with magazine attached, and further are difficult to remove when it is desired to remove the magazine from the binder.

Many other forms of removably securing a plurality of individual sheets from binders can be found in the prior art, but none has the unique advantage of the present invention in removably securing a previously bound booklet into a storage binder for storage and periodic removal therefrom.

Thus, it is seen that at the present time there is no entirely satisfactory technique available for removably securing bound booklets into a storage binder for storage therein and periodic removal therefrom which is inexpensive to manufacture, convenient to use, and long lasting.

SUMMARY OF THE INVENTION

The present invention at least obviates if not entirely eliminates the disadvantages and shortcomings of prior methods of securing bound booklets into storage binders. In its broader aspects, the present invention is a binding device for removably securing bound booklets into a storage binder for storage therein and periodic removal therefrom, and comprises a strip of binding material, means disposed on the strip of binding material for securing a portion of a bound booklet adjacent the bound edge thereof to the strip of binding material, and means operatively associated with the strip of binding material for removably securing the strip of binding material into the storage binder. With this arrangement, the booklet is removably secured into the storage binder for storage and periodic removal therefrom, either with or without the binding material, depending on the manner of securing the booklet thereto.

In some of its more limited aspects, the strip of binding material is formed of a semi-rigid material, such as cardboard or heavy card stock or plastic. In a preferred form of the invention, the strip of binding material is preferably rectangular and is elongate in an axial direction and relatively narrow in the lateral direction. In one form of the invention, the means for securing a portion of the bound booklet adjacent the bound edge thereof to the strip of binding material, and the means for removably securing the strip of binding material into the storage binder, are disposed along opposite longitudinal edges of the strip of binding material. Thus, the rear surface edge portion of the bound booklet may be secured to the strip of binding material directly by a suitable adhesive, or by a removable connecting means, such as adhesively backed hook and loop material, with one portion thereof adhesively secured to the binding material and the other portion thereof adhesively secured to the rear surface edge portion of said booklet.

In another form of the invention, the means for securing a portion of the bound booklet adjacent the bound edge thereof to the strip of binding material, and the means for removably securing the strip of binding material into the storage binder, are disposed along the same longitudinal edge of the strip of binding material. Thus, the bound booklet may be secured by an elongate strip of semi-rigid material extending for substantially the length of the strip of binding material and is secured thereto adjacent the lateral edges thereof so that the strip of material is disposed inside of the bound booklet to capture the bound booklet between a pair of adjacent pages thereto. Similarly, the bound booklet may be secured by a string attached to a surface portion of the strip of binding material and having a length sufficient for the string to extend along the opposite surface of the strip of binding material in the longitudinal direction thereof and be disposed within the bound booklet and be removably connected to the strip of binding material.

In either of the above forms of the invention, the means for securing the strip of binding material into a storage binder may be a plurality of holes punched into the strip of binding material in a pattern suitable for inserting the strip of binding material into a conventional ring binder. Alternatively, a strip of removable hook and loop material may also be utilized for securing the strip of binding material into a storage binder in much the same manner as that used to secure the rear edge portion of a booklet to the strip of binding material.

Having briefly described the general nature of the present invention, it is a principal object thereof to provide a binding device for removably securing bound booklets into storage binders in which the booklets are easily removable from the storage binder for further handling.

Another object of the present invention is to provide a device for removably securing bound booklets into storage binders in which the booklet is also removably from the binding device to accommodate situations where the protruding strip of binding material would interfere with further handling of the bound booklet.

Still another object of the present invention is to provide a device for removably securing bound booklets into storage binders which is very inexpensive to manufacture, simple to use and sufficiently durable to withstand repeated use for a long period of time.

These and other objects and advantages of the present invention will become more apparent from an understanding of the following described presently preferred modes of carrying out the principles of the present invention, when considered in conjunction with the accompanying drawings.

DETAILED DESCRIPTION OF THE PREFERRED EMBODIMENTS

Figure 1:
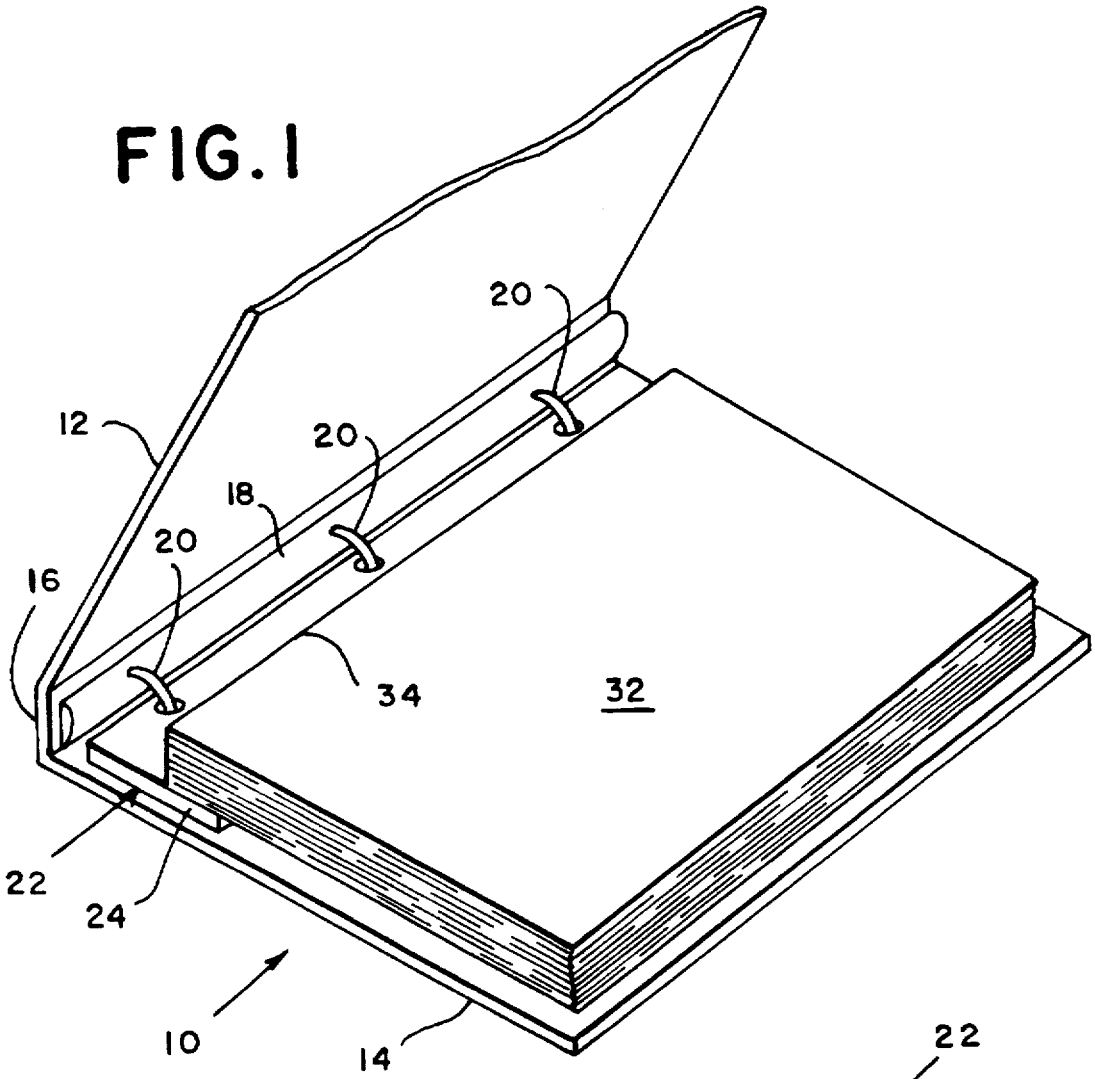
FIG. 1 is a perspective view of one form of a conventional storage binder utilizing the binding device of the present invention.

Referring now to the drawings, and particularly to FIG. I thereof, the binding device of the present invention is shown in operative association with a storage binder, indicated generally by the reference numeral 10. The storage binder shown in FIG. 1 is a conventional three ring binder, but as will become clear from the following description, the binding device of the present invention is applicable to other forms of storage binders.

The storage binder 10 shown in FIG. 1 comprises a front cover 12, typically formed of a suitable relatively stiff material so that it cannot readily bend, a rear cover 14 formed of similar material, and a spine 16 which connects the two covers together. A suitable elongate frame 18 is rigidly connected to the spline 16, the frame supporting a plurality of rings 20 which can be opened and closed in a manner so well known as not to require further illustration or description.

Figure 2:
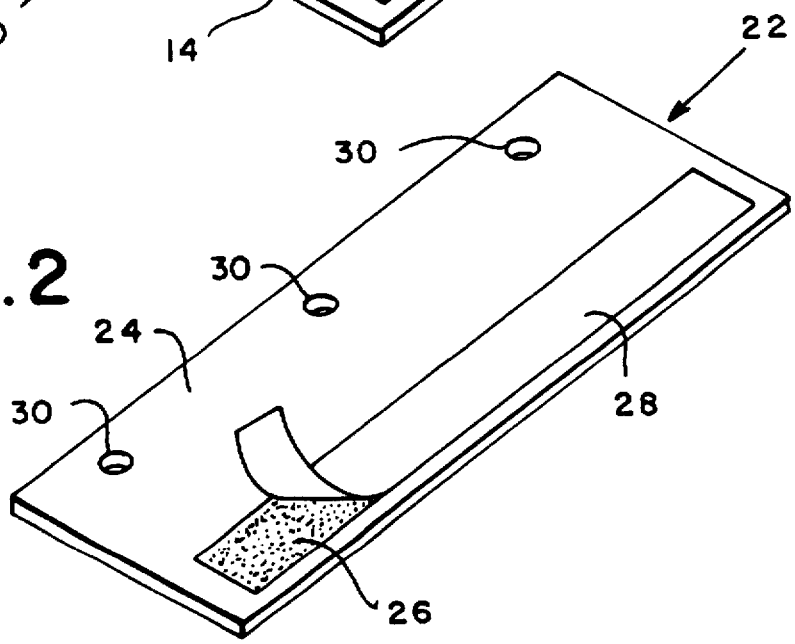
FIG. 2 is a perspective view of one embodiment the binding device of the present invention shown removed from the storage binder shown in FIG. 1.

In one form of the invention, the binding device of the present invention, indicated generally by the reference numeral 22, is illustrated in more detail in FIG. 2, and is seen to comprise a strip of binding material 24, preferably formed of a semi rigid material, such as relatively stiff cardboard, card stock or plastic, but softer materials such as heavy cloth may be used. The strip of binding material 24 may be of any length, as short as an inch or two, but preferably it is rectangular and elongate in the axial direction, has a length that is commensurate with the height of the storage binder 10 with which it is intended for use, as seen in FIG. 1, and a relatively narrow width compared to that length, as will be better understood from the following description.

The strip of binding material 24 is provided with means for securing a portion of a bound booklet adjacent the bound edge thereof to the strip of binding material 24. Thus, in the embodiment shown in FIGS. 1 and 2, a strip of a suitable adhesive material 26 is applied to one face of the strip of binding material, preferably adjacent one longitudinal edge thereof, covering approximately one third to one half of the width of the strip 24. A suitable protective overlay 28 is applied to the adhesive material 26 to prevent anything from sticking thereto before the strip 24 is applied to a bound booklet as described below.

The strip of binding material 24 is also provided with means operatively associated therewith for removably securing the binding material 24 into the storage binder 10. Thus, in the embodiment shown in FIGS. 1 and 2, that means comprises a plurality of holes 30 punched into the strip of binding material 24 adjacent the opposite longitudinal edge from the edge where the adhesive material 26 is located, the number and spacing of the holes 30 corresponding to the number and spacing of the rings 20 of the ring binder 10 with which the binding device 22 is used. If strips of binding material of very short length are used, only one hole would be provided since the strip of binding material would not be long enough to encompass more than one ring.

To use the binding device 24 described above, one first removes the protective overlay 28 from the adhesive 26, and then applies the strip of binding material 24 to an edge portion of the rear sheet or cover of the bound booklet 32, adjacent to the bound edge 34 thereof, being careful to ensure that the entire width of the adhesive material 26 is covered by the rear sheet or cover of the booklet 32. The strip of binding material 24, with the bound booklet 32 attached, is then inserted into the open rings 30 of the ring binder 10 and the rings are closed in known manner. Thus, the bound booklet is removably secured into said storage binder for storage and periodic removal therefrom.

Figure 3:
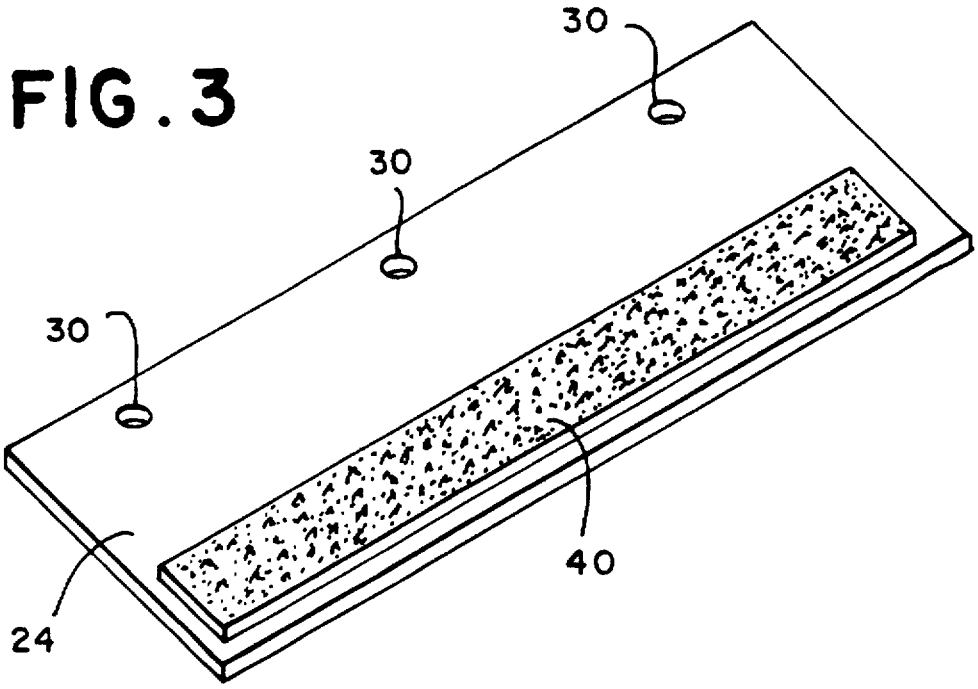
FIGS. 3, 4, 5, and 6 are perspective views similar to FIG. 2 but showing modified forms of the binding device.

In another form of the invention as shown in FIG. 3, the strip of adhesive material 26 is replaced by a strip of a adhesively backed removable connecting material, such as the well known hook and loop material sold under the trademark VELCRO. Thus, a strip 40 of either the hook portion or loop portion of the removable connecting material is adhesively secured to the strip of binding material 24 in the same location as the strip of adhesive material 26. A corresponding strip of the mating portion of the hook and loop material is adhesively secured to the rear surface edge portion of the bound booklet adjacent the bound edge 34, so that when the two mating strips of the hook and loop material are joined together, the booklet 32 is bound to the strip of binding material 24 in the same manner as that illustrated in FIG. 1 where the bound booklet is adhesively secured directly to the strip of binding material 24. The main advantage of this form of the invention is that the booklet 32 can be removed from the storage binder without the necessity of also removing the strip of binding material 24 so that it will not interfere with other handling of the booklet, such as copying or inserting it into an envelope for mailing. However, the strip of binding material 24 can still be removed with the booklet 32 if it is desired to reorganize the contents of the storage binder 10 by rearranging the order of booklets within the binder.

Figure 4:
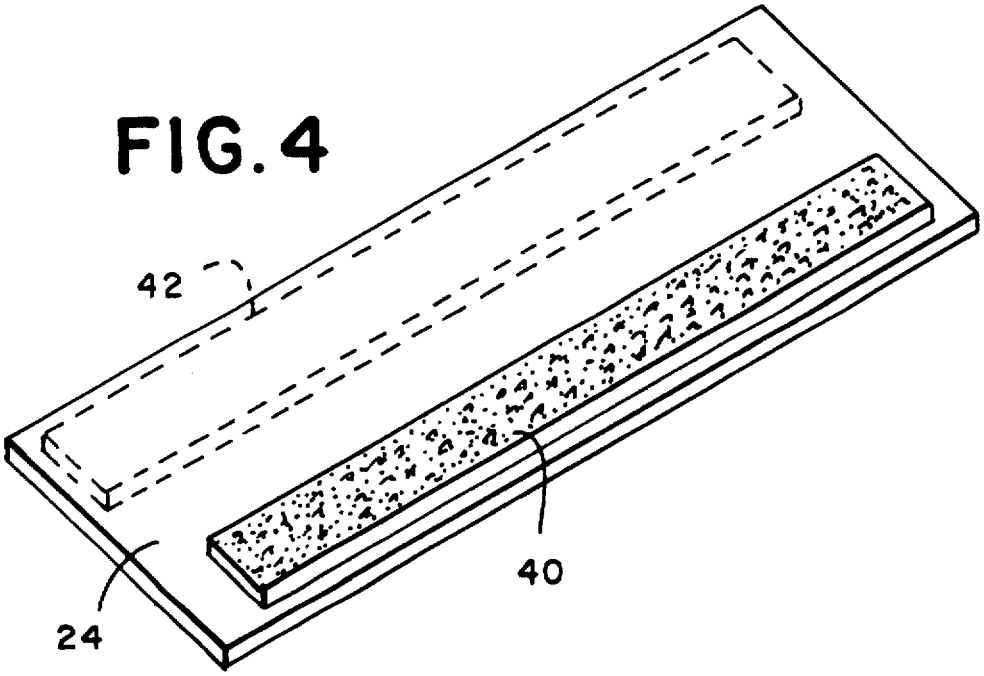

Still another form of the invention is illustrated in FIG. 4, wherein the holes 30 in the strip of binding material 24 have been replaced by another strip 42 of hook and loop material, either the hook portion or the loop portion being adhesively secured to the surface of the strip of binding material 24 opposite to that on which the strip 40 is located. In this form of the invention, a binder is provided in which the frame 18 and the rings 20 have been removed, and the mating portion of the hook and loop material is secured to the inner surface of the rear cover of the binder, directly under the portion of the strip of binding material 24 containing the holes 30 as seen in FIG. 1. Thus, when the two mating portions of the hook and loop material are joined together, the bound booklet is secured into the binder. This form of the invention is particularly useful when the bound booklet is very thick and only one is stored in a single storage binder, yet must still be removed from the storage binder for further handling, such as copying.

Figure 5:
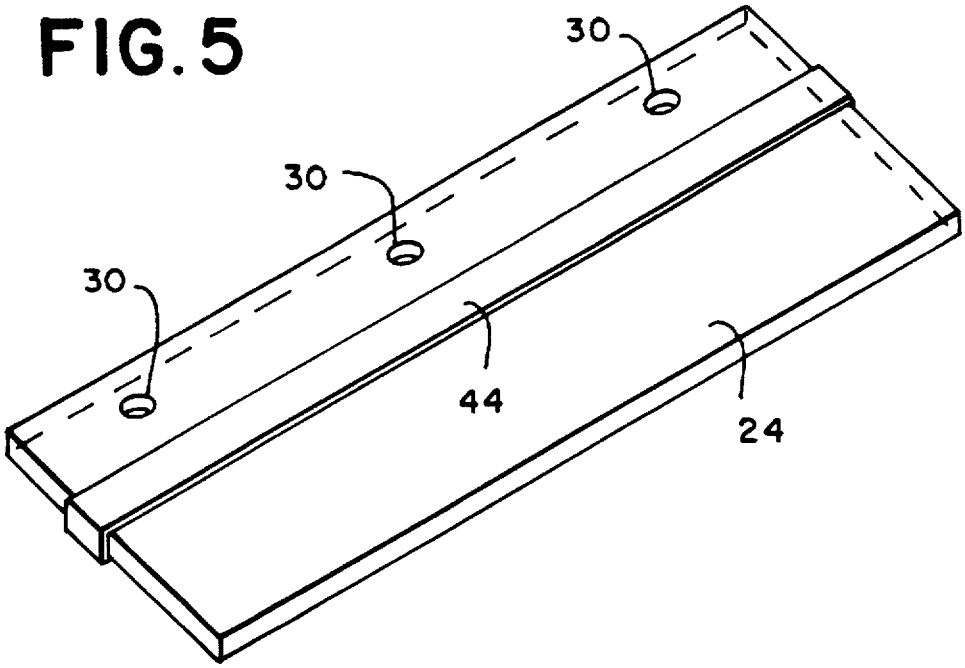

FIG. 5 illustrates still another embodiment of the invention wherein the means for securing a portion of the bound booklet to the binding strip 24 comprises an elongate strip 44 of semi-rigid material, such as a strip of transparent plastic material, which extends for substantially the length of the strip of binding material 24 and is secured thereto adjacent the lateral edges thereof. The strip of material 44 is adapted to be placed between two adjacent pages of the bound booklet, typically in the middle, so as to capture the bound booklet between the adjacent pages.

Figure 6:
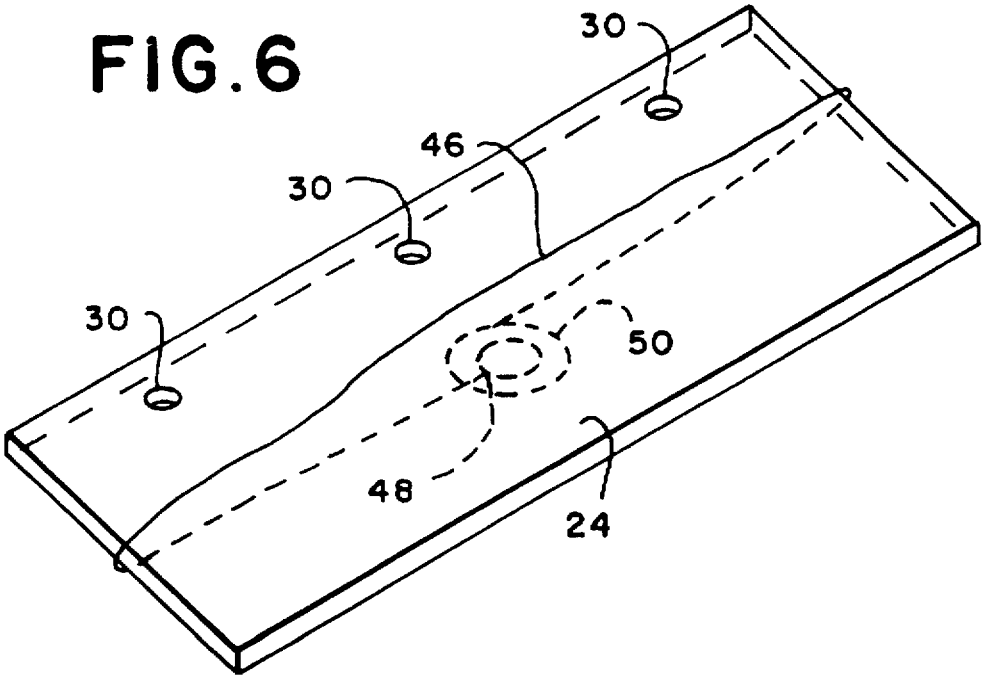

In the embodiment illustrated in FIG. 6, the strip 44 has been replaced by a string 46 suitably attached as at 48 to a surface portion, typically the rear surface, of the strip of binding material 24. The string 46 is long enough to extend completely around the strip of binding material 24 in the longitudinal direction thereof and be reattached to the strip of binding material, such as by the eyelet 50, adjacent the point of attachment of the other end of the string 46 to the rear surface of the strip of binding material 24. In use, the free end of the string 46 is detached from the strip of binding material, inserted into the bound booklet, and re-attached to the eyelet 50 on binding material 24.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

I claim:

1. A binding device for removably securing bound booklets into a storage binder for storage therein and periodic removal therefrom, said device comprising:

(a) a strip of binding material, wherein said strip of binding material is:

(i) rectangular and is elongate in an axial direction and relatively narrow in the lateral direction; and (ii) formed of a durable, semi-rigid material;

(b) means disposed on said strip of binding material for securing a portion of a bound booklet to said strip of binding material;

(i) said means applied to said strip of binding material for securing a portion of said bound booklet adjacent the bound edge thereof to said strip of binding material is disposed along one longitudinal edge of said strip of binding material; and, wherein (ii) said means applied to said strip of binding material for securing a portion of said bound booklet adjacent the bound edge thereof to said strip of binding material comprises a string attached to a surface portion of said strip of binding material and having a length sufficient for said string to extend along the opposite surface of said strip of binding material in the longitudinal direction thereof and be disposed within said bound booklet and be attached to said one surface of said strip of binding material; and (c) means operatively associated with said strip of binding material for removably securing said strip of binding material into said storage binder, whereby said booklet is removably secured into said storage binder for storage and periodic removal therefrom; and wherein said means operatively associated with said strip of binding material is disposed along the same longitudinal edge of said strip of binding material.

2. A device for securing bound booklets into a storage binder as set forth in claim 1 wherein said means applied to said strip of binding material for securing a portion of a said bound booklet adjacent the bound edge thereof to said strip of binding material is disposed along one longitudinal edge of said strip of binding material.

3. A device for securing bound booklets into a storage binder as set forth in claim 2 wherein said means operatively associated with said strip of binding material for removably securing said strip of binding material into said storage binder is disposed along the longitudinal edge thereof opposite from said one longitudinal edge thereof.

4. A device for securing bound booklets into a storage binder as set forth in claim 3 wherein said means applied to said binding material for securing a rear surface edge portion of a booklet to said binding material comprises adhesive material.

5. A device for securing bound booklets into a storage binder as set forth in claim 3 wherein said means applied to said binding material for securing a rear surface edge portion of a booklet to said binding material comprises removable connecting means having one portion thereof secured to said binding material and the other portion thereof secured to said rear surface edge portion of said booklet, whereby said booklet can be removed from said storage binder and said binding material without said binding material being removed from said storage binder.

6. A device for securing bound booklets into a storage binder as set forth in claim 5 wherein said removable connecting means comprises adhesively backed hook and loop material, said hook and loop material further comprising a first portion and a second portion wherein said first portion and said second portion can be joined together by a plurality of interlocking hooks and loops resident on each of said portions with said first portion thereof adhesively secured to said binding material and said second portion thereof adhesively secured to said rear surface edge portion of said booklet.

7. A device for securing bound booklets into a storage binder as set forth in claim 3 wherein said means applied to said strip of binding material for removably securing said strip of binding material into said storage binder comprises a plurality of holes punched into said binding material in a pattern suitable for insertion of said binding material into a ring binder.

8. A device for securing bound booklets into a storage binder as set forth in claim 3 wherein said means applied to said strip of binding material for removably securing said strip of binding material into said storage binder comprises a strip of hook and loop material, said hook and loop material further comprising a first portion and a second portion adhesively secured to said strip of binding material and said storage binder respectively.

9. A device for securing bound booklets into a storage binder as set forth in claim 7 wherein said means applied to said strip of binding material for securing a portion of said bound booklet adjacent the bound edge thereof to said strip of binding material comprises an elongate strip of semi-rigid material extending for substantially the length of said strip of binding material and is secured to said strip of binding material adjacent the lateral edges thereof, said strip of material being adapted to be placed inside of said bound booklet to capture said bound booklet between a pair of adjacent pages thereof.

* * * * *